US007591258B2

(12) United States Patent
Nagel et al.

(10) Patent No.: US 7,591,258 B2
(45) Date of Patent: Sep. 22, 2009

(54) EXHAUST TEMPERATURE BASED CONTROL STRATEGY FOR BALANCING CYLINDER-TO-CYLINDER FUELING VARIATION IN A COMBUSTION ENGINE

(75) Inventors: Juergen Nagel, Gettorf (DE); Bert Ritscher, Altenholz (DE); Alan R. Schroeder, Kiel (DE)

(73) Assignee: Caterpillar Motoren GmbH & Co. KG, Kiel (DE)

( * ) Notice: Subject to any disclaimer, the term of this patent is extended or adjusted under 35 U.S.C. 154(b) by 28 days.

(21) Appl. No.: 11/808,894

(22) Filed: Jun. 13, 2007

(65) Prior Publication Data

US 2007/0289584 A1 Dec. 20, 2007

(30) Foreign Application Priority Data

Jun. 14, 2006 (DE) ..... 10 2006 027 591

(51) Int. Cl.
*F02D 41/00* (2006.01)
*F02M 69/46* (2006.01)

(52) U.S. Cl. ..... 123/676; 123/478; 123/456

(58) Field of Classification Search ..... 123/299, 123/676, 478, 456, 436, 458, 481, 479, 446, 123/447

See application file for complete search history.

(56) References Cited

U.S. PATENT DOCUMENTS 4,807,581 A * 2/1989 Nishikawa et al. ..... 123/488
4,835,964 A * 6/1989 Kume et al. ..... 60/285
5,131,371 A 7/1992 Wahl et al.
6,000,384 A * 12/1999 Brown et al. ..... 123/676
6,289,871 B1 * 9/2001 Brown et al. ..... 123/299
6,694,953 B2 * 2/2004 Barnes et al. ..... 123/500
6,755,176 B2 * 6/2004 Takeuchi et al. ..... 123/299
6,907,862 B2 * 6/2005 Kitahara ..... 123/434
7,021,045 B2 * 4/2006 Yomogida et al. ..... 60/285

FOREIGN PATENT DOCUMENTS

DE 75180 8/1970
DE 249 941 A1 9/1987
DE 39 29 746 A1 3/1991
WO WO 99/45254 9/1999

OTHER PUBLICATIONS

German Patent Office Action dated Feb. 9, 2007, in Application No. 102006027591.8 (3 pages).

* cited by examiner

*Primary Examiner*—Stephen K. Cronin
*Assistant Examiner*—Johnny H. Hoang
(74) *Attorney, Agent, or Firm*—Finnegan, Henderson, Farabow, Garrett & Dunner

(57) ABSTRACT

The present disclosure provides a control strategy for balancing injector-to-injector fueling variations for a combustion engine having multiple combustion chambers (and cylinders), with multiple individually actuated injectors for injecting fuel into the combustion chambers, wherein at least one injector is assigned to each combustion chamber and a common rail supplies fuel to the multiple injectors. The method includes changing the actuation waveform of an injector assigned to a combustion chamber having an exhaust gas temperature deviating by more than the predetermined value from the average exhaust gas temperature, in order to change the amount of fuel injected.

29 Claims, 4 Drawing Sheets

EXHAUST TEMPERATURE BASED CONTROL STRATEGY FOR BALANCING CYLINDER-TO-CYLINDER FUELING VARIATION IN A COMBUSTION ENGINE

TECHNICAL FIELD

The present disclosure relates to an exhaust temperature based control strategy for balancing cylinder-to-cylinder fueling variation in a combustion engine and, more particularly, to a combustion engine having a common rail injection system.

BACKGROUND

Combustion engines with a common rail injection system are generally known. In this type of combustion engine multiple combustion chambers (and cylinders) are provided. An injector is allocated to each combustion chamber, with each injector connected to a common high pressure rail, (generally called a common rail) for supplying fuel. In common rail systems, due to production tolerances of the injectors (along with other contributing factors), variations with regard to the quantity of fuel injected by individual injectors occur. These differences in the quantity of fuel injected lead to variations in the respective exhaust gas temperatures of the combustion chambers.

One known method to account for this variation is to measure the injection characteristics of each injector after production and to note this on the injector in coded form, for example in the form of a bar code. When the injector is fitted to an engine, this information is then entered into the control unit of the engine by a corresponding reading device. The control unit is then able to control the injectors using their unique, individually measured injection characteristics in order to provide uniform injection among the engine's combustion chambers. This type of method is called Electronic Trim (or e-trim).

The method known as e-trim, however, is rather complex and requires a special reading device when injectors are installed in an engine in order to input the coded information of the individual characteristics of the injector into the engine control unit. For the correct input of this information, a certain degree of training and care are required. Also, with the e-trim method the injection characteristics of the injectors are measured only in the new state. Therefore, the method is not able to take into account the effect of wear and tear which changes the injection characteristics of the injector throughout its service life. This may lead to problems if, for example, a single or several (but not all) injectors are changed on an engine. In this case, the same engine is provided both with new injectors, the injection characteristics of which are known in the new state, and with old injectors, the injection characteristics of which were originally known but which may have changed. However, because the engine control assumes that the old injectors still have the same injection characteristics as in the new state, considerable differences can arise with regard to the injection of fuel into the individual combustion chambers.

In large engines, for example in engines for marine applications, it is known to monitor the exhaust gas temperatures of the individual combustion chambers and to issue a warning if the exhaust gas temperature of a combustion chamber substantially deviates from the exhaust gas temperatures of the other combustion chambers. This type of temperature deviation can be due to different reasons and may indicate a serious malfunction or damage to the combustion engine. One source of exhaust gas temperature deviations is the quantity of fuel which has been supplied to each combustion chamber, and this can depend upon normal tolerances of the fuel injection system. For example, injectors often have flow rate tolerances of +/−5% and more. Some current injectors have a flow rate tolerance of +2.5% and −1.5%.

The purpose of the present disclosure is to improve engine performance and to reduce false alarms from exhaust gas temperature monitoring systems.

SUMMARY OF THE INVENTION

According to the disclosure, a method is provided for controlling a combustion engine having multiple combustion chambers (and cylinders), with individually controllable injectors for injecting fuel into the combustion chambers (with at least one injector being assigned to each combustion chamber) and a common rail for supplying fuel to each of injectors. The method is comprised of the following: actuating the injectors on the basis of a requested fuel map, monitoring the exhaust gas temperature of each combustion chamber, determining an average exhaust gas temperature of the combustion chambers, determining whether the exhaust gas temperature of an individual combustion chamber deviates by more than a predetermined value from the average exhaust gas temperature and changing the actuating of an injector which is assigned to a combustion chamber whose exhaust gas temperature deviates by more than the predetermined value from the average exhaust gas temperature in order to change the amount of fuel injected. By monitoring the exhaust gas temperatures of each combustion chamber, the method enables adaptation of the quantity of fuel injected into each combustion chamber in order to achieve equalization of the exhaust gas temperatures and to optimize the performance of the engine by achieving equalization of the quantity of fuel respectively injected. In one variant of the disclosure, the predetermined value is a percentage of the average exhaust gas temperature. The predetermined value of the temperature deviation is typically between 10° C. and 30° C., and may be approximately 20° C.

In order to prevent major malfunctions or damage to the combustion engine from going undetected, the number of changes for each injector is preferably limited to a certain number. In this way, changes to the exhaust gas temperature which are not due to tolerance differences of the injectors or which are not based upon the amount of fuel injected, can be prevented from going unnoticed. Furthermore, the amount of each incremental change to the injector actuation waveform may correspond to a predetermined value in order to achieve uniform equalization of the exhaust gas temperatures. In addition, the total amount of the change to the actuation waveform of a respective injector may be limited. This may be useful to prevent changes to an injector waveform when the exhaust gas temperature deviation of a combustion chamber is either not due to tolerance differences of the injectors, or not based upon the amount of fuel injected. In these cases, adjusting the injector actuation waveform could prevent major malfunctions from being detected. The amount of any change or the total amount of the change(s) to the actuation of a respective injector may be determined as a percentage of the unchanged actuation according to the original fuel request map. Normal actuation of the injector according to the original fuel request map is therefore used as the basis for limiting the extent of each individual change or the total extent of the change(s). A larger or smaller change is therefore possible depending on the fuel request map. For example, when operating the combustion engine under normal load conditions, smaller changes to the actuation are possible than when operating in full or overload conditions of the engine. The maximum overall extent of the change(s) comes within a range of between 1 and 10%, and may be 4%, as flow rate tolerances for the injectors come within this range.

The above procedure may be repeated cyclically in order to provide a corresponding optimization during the engine operation. After a change to the actuation waveform of an injector, a predetermined period of time may elapse before the repetition of the steps. This period of time should be long enough so the system may be given the possibility of stabilizing a change to the exhaust gas temperature brought about by the change to the actuation waveform of an injector. In some variants, the change settings and change history are recorded. This type of recording makes it possible to determine irregularities when checking the engine. Furthermore, recording the change settings makes it possible for the settings to be maintained when the combustion engine is restarted. If the changes are due to production tolerances of the fuel supply system, when the engine is restarted it can be operated directly with the previously optimized settings. In an alternative variant of the disclosure, the change values may be reset when the combustion engine is restarted.

It also may be determined whether the exhaust gas temperature of a combustion chamber deviates by more than a predetermined maximum value from the average exhaust gas temperature, (this value being greater than the accepted deviation) in which case a corresponding warning signal is issued. Since an excessive deviation of the exhaust gas temperature of a combustion chamber indicates a substantial malfunction, this type of deviation may be signaled without delay. The predetermined maximum value may once again be expressed as a percentage of the average exhaust gas temperature.

The disclosed variants are explained in greater detail below with reference to the drawings.

DETAILED DESCRIPTION

Figure 1:
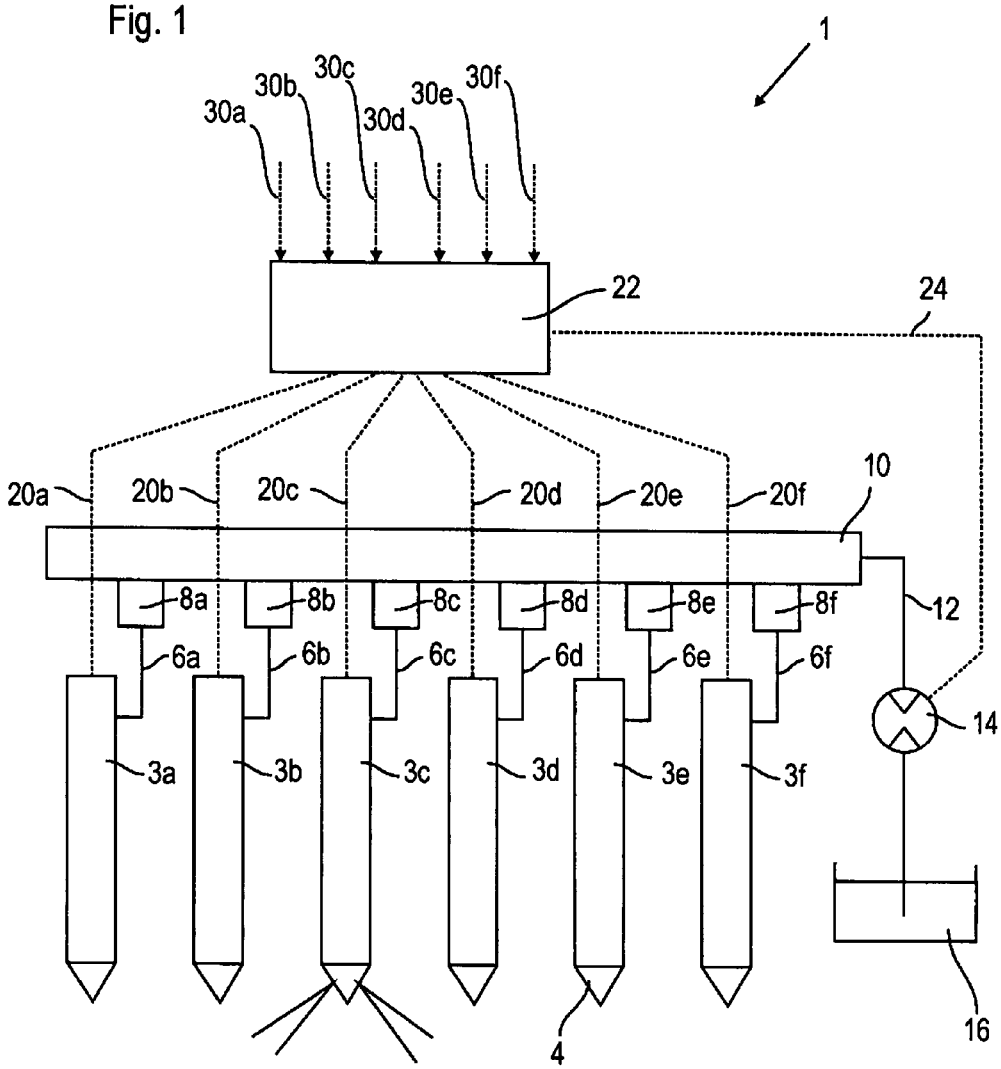
FIG. 1 is a schematic diagram of the structure of a control system for a combustion engine having multiple combustion chambers.
Figure 2:
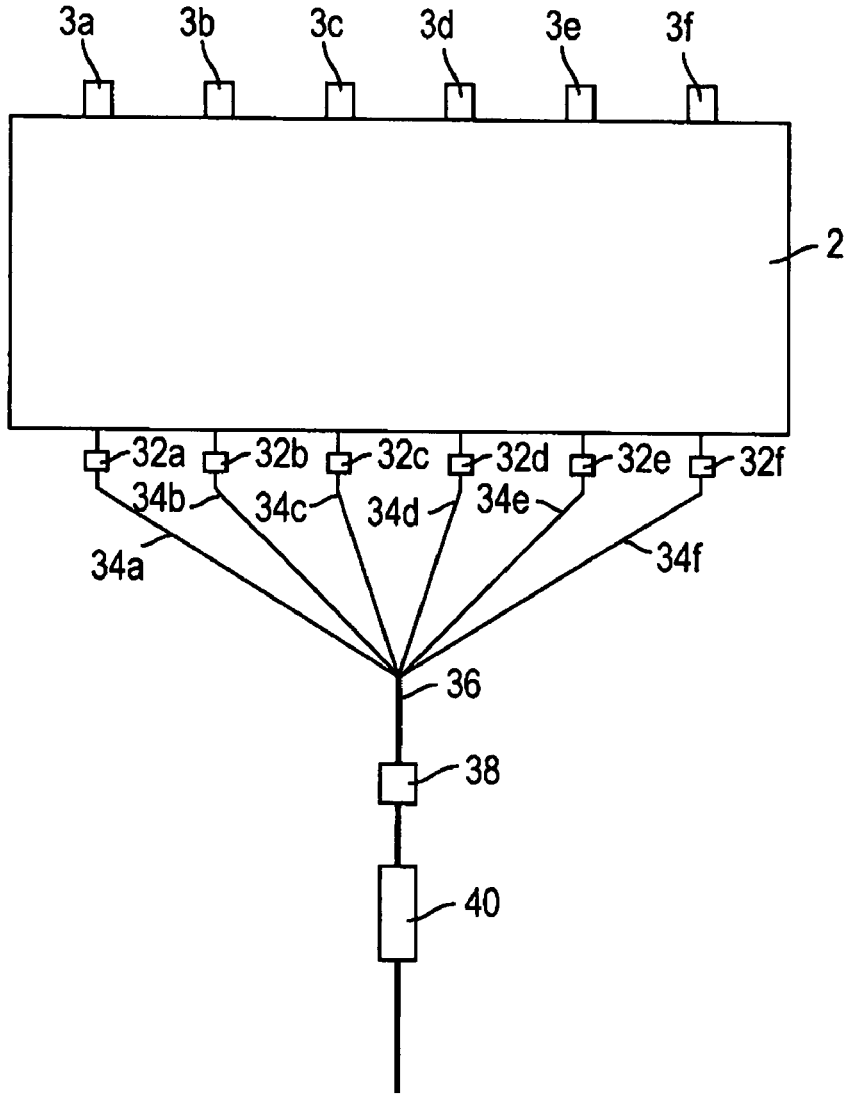
FIG. 2 is a schematic diagram of parts of the combustion engine and of the control system.

FIGS. 1 and 2 schematically show the structure of a control system (1) for a combustion engine (2) having multiple combustion chambers (and cylinders) (not shown). For simplification of the illustration, the combustion engine (2) is only shown schematically in FIG. 2. However, FIG. 1 shows multiple injectors (3*a* to 3*f*), an injector being assigned to each combustion chamber of the combustion engine (2). The injectors (3*a* to 3*f* each have a nozzle tip (4) pointing into the corresponding combustion chamber for injecting fuel into the combustion chamber. Although six injectors are shown in the figures, a different number of injectors (and combustion chambers) may be provided.

The injectors (3*a* to 3*f*) are respectively connected by a fuel line (6*a* to 6*f*) and a flow limiting valve (8*a* to 8*f*) to a common high pressure rail (10), generally called a common rail. The flow limiting valves have a flow rate limited quantity which is chosen for the whole performance range of the engine from a no-load condition to an overload condition such that in normal operation a stop position blocking flow through the flow limiting value is not reached. The flow rate limit is typically ≧30% higher than a quantity of fuel required for rated load operation. The common rail (10) is in turn connected by a line (12) and a high pressure pump (14) to a fuel reservoir (16).

The injectors (3*a* to 3*f*) are connected by corresponding signal lines (20*a* to 20*f*) to a control unit (22) which controls the opening and closure of the injectors (3*a* to 3*f*), e.g., the movement of a nozzle needle relative to a nozzle seat, in a known manner. The amount of fuel injected per injection cycle is controlled by the opening duration of the injector. The control unit (22) is also connected to the high pressure pump (14) by a signal line (24) in order to control operation of the latter. The control unit (22) is furthermore connected to temperature sensors (32*a* to 32*f*) by corresponding signal lines (30*a* to 30*f*).

As can be seen in FIG. 2, the temperature sensors (32*a* to 32*f*) are respectively mounted on exhaust gas lines (34*a* to 34*f*) of the combustion chambers in order to measure the exhaust gas temperature of each combustion chamber individually. The individual exhaust gas lines (34*a* to 34*f*) are combined to form a common exhaust gas line (36) in which a further, optional temperature sensor (38) and a turbocharger (40) are mounted. The optional temperature sensor (38) can be used to directly measure an average exhaust gas temperature of all of the combustion chambers since all of the exhaust gases run together into the common exhaust gas line (36). Although in FIG. 1 the signal lines (30*a* to 30*f*) are shown running directly into the control unit (22), between the control unit (22) and the signal lines, an exhaust gas monitoring unit can be provided which processes the signals of the temperature sensors and makes them available in the processed form to the control unit (22).

Figure 3:
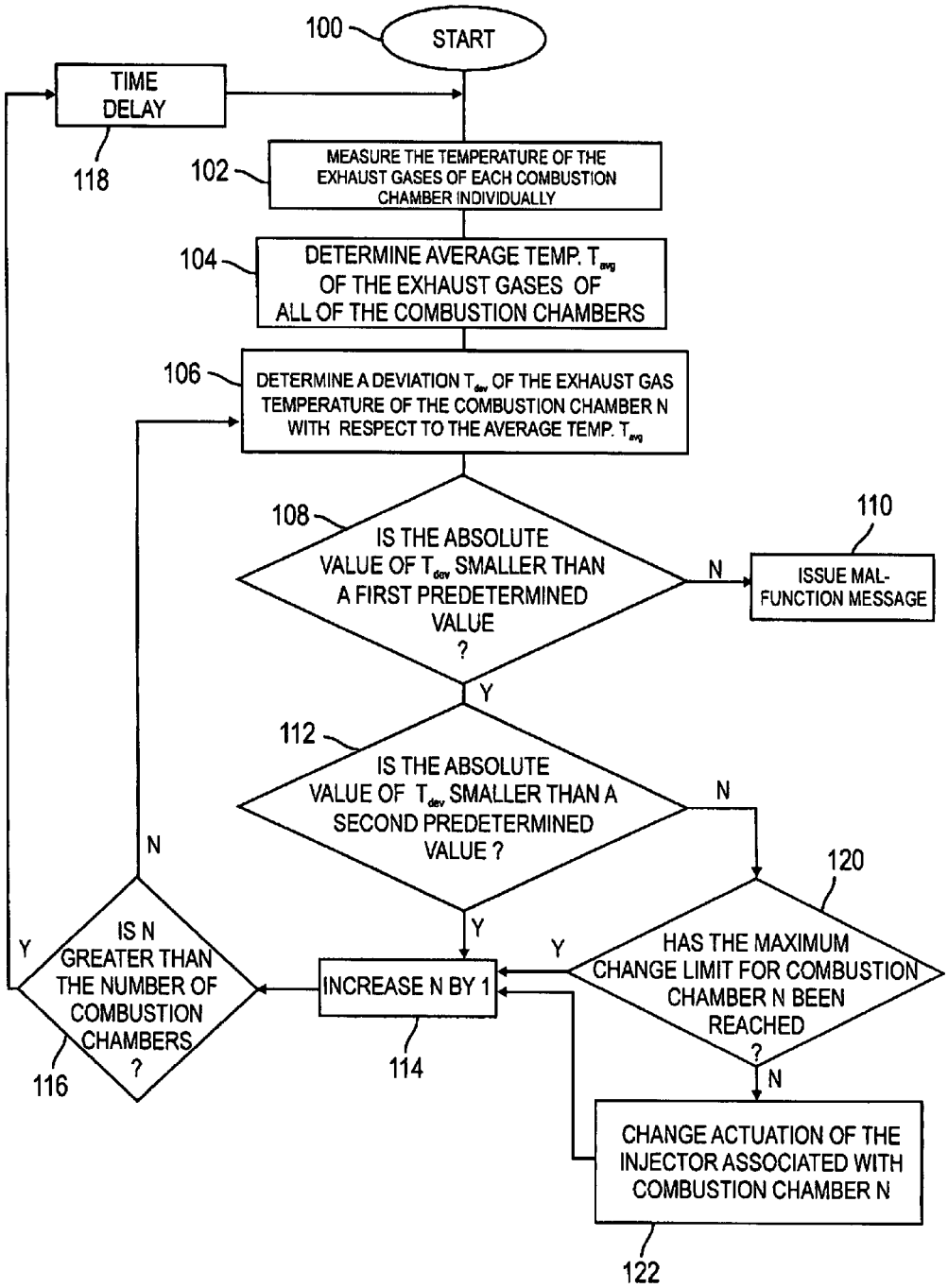
FIG. 3 is a flow chart showing a process sequence of the control system according to a first variant.

The control system (1) according to a first variant of the disclosure is described in greater detail with reference to the flow chart shown in FIG. 3. The individual process steps are controlled by the control unit. In block 100, the engine is started and the individual injectors are controlled by means of a requested fuel map, as is common in engine technology. Next, in block 102, the temperatures of the exhaust gases of each combustion chamber are individually measured. The temperature measurement is implemented by means of the temperature sensors (32*a*-32*f*), and the corresponding temperature signals are transferred to the control unit (22) by the signal lines (30*a*-30*f*). Next the control passes to block 104. In block 104 an average temperature $T_{avg}$ of the exhaust gases is established for all of the combustion chambers. This can be done mathematically by means of the temperature signals for each combustion chamber or by means of a temperature measurement of the temperature sensor (38) which is provided on the common exhaust gas line (36), and thus provides an average value. Next the process control passes to block 106 in which a deviation $T_{dev}$ of the exhaust gas temperature of a combustion chamber N with respect to the average temperature $T_{avg}$ is established. N is a whole number between 1 and the number of combustion chambers, and is set to 1 at the start of the control system.

It is then determined in block 108 whether the exhaust gas temperatures lie within predetermined limits, wherein the predetermined limits may be absolute limits or may be determined in accordance with a requested map. In the determination it is established whether the absolute value of $T_{dev}$ established in block 106 is smaller than a first predetermined value. In this way it is determined whether the temperature deviation with respect to the average temperature comes within predetermined limits. The first predetermined value may be a fixed temperature of, for example, 40° C. or a percentage of the average exhaust gas temperature, such as 10%, and thus may change during operation of the engine.

If the exhaust gas temperatures lie outside of the predetermined limits, this indicates a substantial malfunction of the engine and the process control passes to block 110 in which a corresponding malfunction message is issued and, if applicable, operation of the engine is halted. If the exhaust gas temperatures lie within the predetermined limits, the process control passes to block 112. In block 112 it is determined whether the absolute value of $T_{dev}$ is smaller than a predetermined second value. In this way it is determined whether the temperature deviation with regard to the average temperature lies within second, more-narrow predetermined limits. The predetermined value may be a fixed temperature of, for example 20° C., or a percentage of the average exhaust gas temperature, such as 5%, and thus may change during operation of the engine. If the absolute value of $T_{dev}$ is smaller than the predetermined value, this shows correct operation of the engine, and the process control passes to block 114. In block 114, N is increased by 1, i.e. N is set to equal N+1.

Next, the process control passes to block 116 where it is determined whether N is greater than the number of combustion chambers. If this is not the case, the process control returns to block 106 in which a temperature deviation $T_{dev}$ of the exhaust temperature of the next combustion chamber with respect to the average temperature $T_{avg}$ is in turn determined. If in block 116, however, N is greater than the number of combustion chambers, the process control passes to block 118. If N is greater than the number of combustion chambers, this indicates that the temperature deviation $T_{avg}$ for each combustion chamber with respect to the average temperature has been determined and has been reacted to accordingly. Block 118 is a time delay block which allows the process to pause for a predetermined period of time before the process passes back to block 102 and a new cycle is implemented.

If it is determined in block 112 that the absolute value of $T_{dev}$ is smaller than the predetermined value, this indicates that the engine is not running fully optimally, but that the deviation is not so substantial that a malfunction message should be issued, and the process control passes to block 120. In block 120 it is determined whether a maximum change limit for the combustion chamber N has been reached. As will be explained in greater detail below, the control system is able to change the actuation of the injectors (3*a*-3*f*) which are normally actuated in accordance with the requested fueling map in order to change the amount of fuel injected by the latter. However, the control system should not be able to change the actuation limitlessly, and so a change limit is defined, for example, as a percentage change to the actuation which would normally be implemented according to the requested fueling map.

If it has been determined in block 120 that the maximum change limit for the combustion chamber N has been reached, the process control passes to block 114 where N is once again increased by 1, and the process control follows the process described above. In decision block 120, when determining whether the maximum change limit for the combustion chamber N has been reached, it is taken into account whether a subsequent change would include a step away from the maximum change limit to the normal actuation according to the requested fueling map, or a step beyond the maximum change limit. In other words, if the maximum change limit for the combustion chamber N has been reached and a subsequently planned change would result in the limit being exceeded, this change is then not permitted, and control passes to block 114.

If the subsequently planned change would result, however, in a step away from the maximum change limit to the normal actuation according to the requested fueling map, the process control then passes to block 122. The process control also passes to block 122 if it has been determined in block 120 that the maximum change limit for the combustion chamber N has not yet been reached. In block 122 the actuation waveform of the injector allocated to the combustion chamber N is changed. The change to the actuation results in longer opening or faster closure of the injector in order to increase or to reduce the quantity of fuel injected into the combustion chamber N. Next, the process control passes back to block 114 in which the value N is increased by 1 and the process control then follows the previously described process sequence.

The process described above is one variant of the disclosure and enables equalization of the exhaust gas temperatures of the different combustion chambers of a combustion engine having a common rail injection system within predetermined limits. It is clear from the above description that the corresponding degree of change to the actuation waveform for the respective injectors is recorded. These recorded values are preferably stored in a permanent memory and can be read out for various purposes, such as for a system check for example. Furthermore, the recorded values may be used as a basis for actuating the individual injectors when an engine is restarted. In this way, during normal operation of the engine it is possible for the engine, when restarted, to be operated from the start with an optimized actuation map. Following maintenance or repair work to the engine, the changed values may be, however, reset to the normal actuation map.

Figure 4:
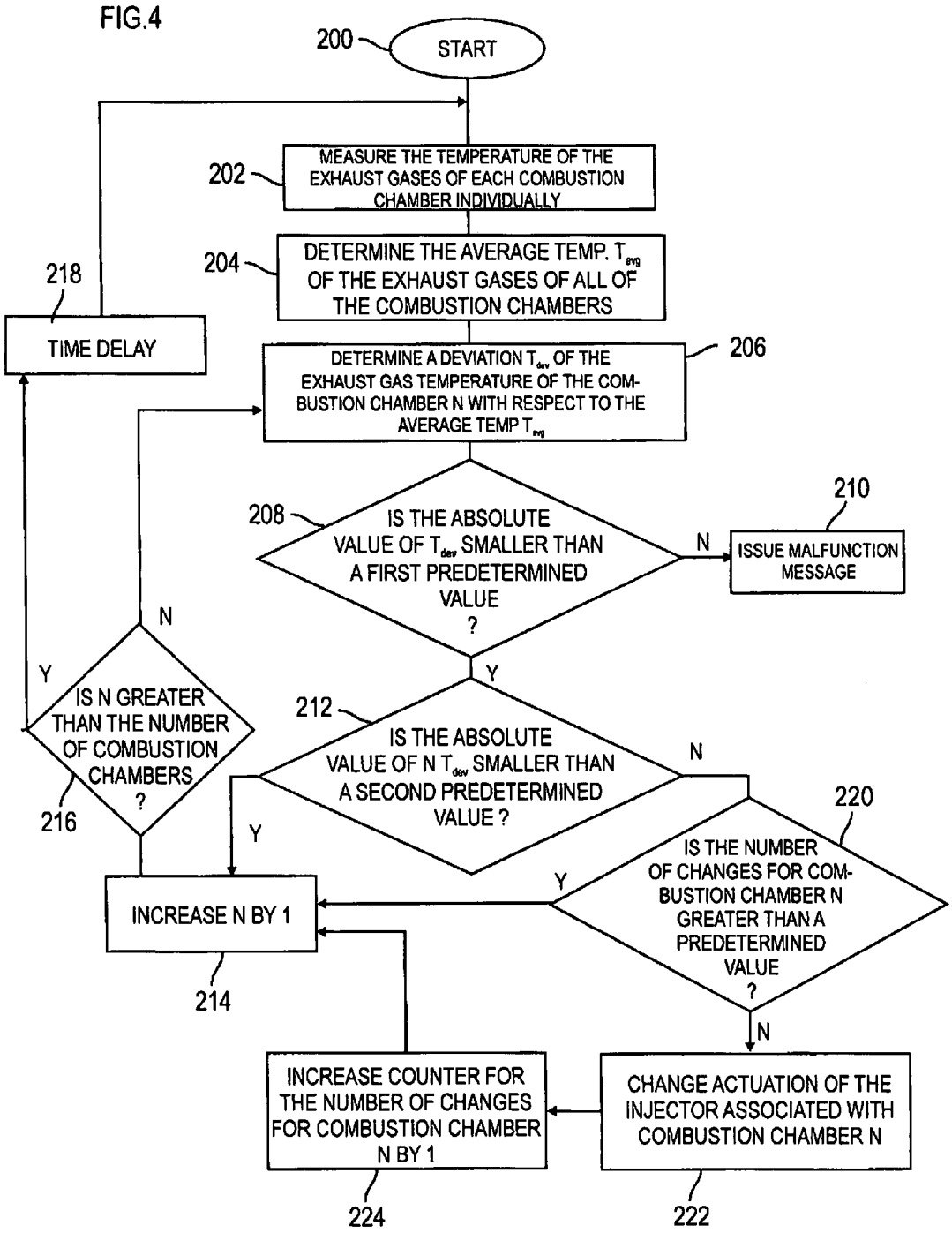
FIG. 4 is a flow chart showing a process sequence of the control system according to a second variant.

The control system (1) according to a second variant of the disclosure is explained in greater detail with reference to the flow chart shown in FIG. 4. The individual process steps may again be controlled by the control unit. In block 200 the engine is started and the individual injectors are controlled by means of a requested fueling map, as is common in engine technology. Next, in block 202 the temperatures of the exhaust gases of each combustion chamber are individually measured. The temperature measurement is implemented, for example, by means of the temperature sensors (32*a*-32*f*), and the corresponding temperature signals are transferred to the control unit (22) by the signal lines (30*a*-30*f*). In block 204 an average temperature $T_{avg}$ of the exhaust gases of all combustion chambers is then determined as before. The process control now passes to block 206 in which a deviation $T_{dev}$ of the exhaust gas temperature of a combustion chamber N with respect to the average temperature $T_{avg}$ is determined. N is a whole number between 1 and the number of combustion chambers and is set to 1 at the start of the control system.

In block 208 it is then determined whether the exhaust gas temperatures lie within predetermined limits, these limits possibly being on the one hand absolute limits and on the other hand being determined in accordance with the requested fueling map. With this determination, it is established whether the absolute value of $T_{dev}$ determined in block 206 is smaller than a first predetermined value. In this way it is determined whether the temperature deviation with respect to the average temperature lies within the predetermined first limits. The first predetermined value may be a fixed temperature of, for example, 40° C., or a percentage of the average exhaust gas temperature, such as 10%, and thus may change during operation of the engine.

If the exhaust gas temperatures lie outside of the predetermined limits, this indicates a substantial malfunction of the engine, and the process control passes to block 210 in which a corresponding malfunction message is issued, and if applicable, operation of the engine is halted. If, however, the exhaust gas temperatures lie within the predetermined first limits, the process control passes to block 212. In block 212 it is determined whether the absolute value of $T_{dev}$ is smaller than a second predetermined value which is smaller than the first predetermined value. In this way it is determined whether the temperature deviation with respect to the average temperature lies within second, narrower predetermined limits. The second predetermined value may be a fixed temperature of, for example, 20° C. or a percentage of the average exhaust gas temperature, such as 5%, and thus may change during operation of the engine. If the absolute value of $T_{dev}$ is smaller than the second predetermined value, the process control passes to block 214. In block 214, N is increased by 1, i.e. N is set to equal N+1.

Next, the process control passes to block 216 where it is determined whether N is greater than the number of combustion chambers. If this is not the case, the process control passes back to block 206 in which a temperature deviation $T_{dev}$ of the exhaust temperature of the next combustion chamber with respect to the average temperature $T_{avg}$ is in turn determined. If, however, in block 216 N is greater than the number of combustion chambers, the process control passes to block 218. If N is greater than the number of combustion chambers, this indicates that the temperature deviation for each combustion chamber with respect to the average temperature has been established and has been reacted to accordingly. Block 218 is a time delay block which allows the process to pause for a predetermined period of time before the process passes back to block 202 and a new cycle is begun.

Up to this point, the process sequences of the first and the second variants are the same. If it is determined in block 212 that the absolute value of $T_{dev}$ is smaller than the second predetermined value, the process control passes to block 220 rather than to block 214. As explained in greater detail below, the control system is able to change the actuation of the injectors (3*a*-3*f*), which are normally controlled by means of the requested fueling map, in order to change the quantity of fuel injected by the injectors. However, it may be desired to have the control system not able to change the actuation limitlessly, and thus a maximum number of change steps are defined which respectively have a predetermined value, and for example a percentage change to the actuation with respect to the normally implemented actuation according to the requested fueling map. For example, a change step can include a change of ±0.5% with respect to the "normal" actuation.

In block 220 it is determined whether the number of previously undertaken change steps with regard to the combustion chamber N has reached a predetermined value of, for example, 10. Only the number of change steps away from the "normal" actuation defined by the requested fueling map are taken into account. If, following changes away from the normal actuation map, a change step towards the normal actuation profile is undertaken, the number of change steps away from the normal actuation map is correspondingly corrected. Therefore, the number of change steps indicates how far the actuation of an injector deviates from its normal actuation (for example five increases of +0.5% each, i.e. 2.5% deviation with respect to the normal actuation map). Furthermore, it is also taken into consideration whether the next change would include a step towards the normal actuation or away from it.

If it has been determined in block 220 that the number of changes has reached the maximum number for the combustion chamber N and the subsequently planned change step would exceed the maximum number, the process control passes to block 214. In block 214, N is once again increased by 1 and the process control follows the further process already described above. If, however, the subsequently planned change would result in a step away from the maximum number of changes to the normal actuation defined by the requested fueling map, the process control then passes to block 222. The process control also passes to block 222 if it has been determined in block 220 that the maximum change limit for the combustion chamber N has not yet been reached. In block 222, the actuation of the injector allocated to the combustion chamber N is changed. The change to the actuation results in longer opening or faster closure of the injector in order to increase or to reduce, respectively, the quantity of fuel injected by the injector into the combustion chamber N. Next, the process control passes again to block 214 in which the value N is increased by 1 and the process control then follows the sequence described above.

In another variant of the disclosure, the process may use a small percentage of the nominal requested fueling for the incremental changes of the injection actuation waveform rather than an absolute, fixed amount. In this way, the process can be used for both low and high fueling levels of the engine.

In still another variant of the disclosure, the process may allow for an offset of exhaust gas temperature in cylinders based on cylinder location. Due to the different locations of the exhaust gas temperature measurements, an engine with exactly the same amount of fuel delivered to each cylinder will still have some variation between the exhaust gas temperatures measured for each cylinder. The process can account for this by using a predefined offset for the cylinder exhaust gas temperatures.

INDUSTRIAL APPLICABILITY

The process sequences described represent different variants of the disclosure, without however, being restricted to the described variants. In the process sequences described, a deviation $T_{dev}$ of the exhaust gas temperature is respectively determined for a single combustion chamber (blocks 106/206). Next, the deviations established are compared with specific threshold values (blocks 112/212) and, if necessary, an adaptation of the actuation waveform of the injector allocated to the respective combustion chamber is implemented (blocks 122/222). After this, the deviation $T_{dev}$ of the exhaust gas temperature is then respectively established for the next combustion chamber, and the corresponding value is provided for the steps.

Alternatively to this sequential determination of the temperature deviation for each individual combustion chamber and the implementation of the subsequent steps (comparison with specific limit values/if appropriate change to the actuation waveform of an injector, etc.) it is also possible to determine the temperature deviations for all combustion chambers or a group of combustion chambers simultaneously, and to provide the corresponding values simultaneously for the subsequent steps. In other words, instead of sequential processing of the temperature signals, provision is also made for the parallel processing of the same.

The disclosed variants of methods for balancing cylinder-to-cylinder fueling variation in a combustion engine provide improved engine performance and reduction in false alarms with gas temperature monitoring systems. The present disclosed variants have been described above with respect to preferred variants of the disclosure, without being restricted to the specifically described variants. The person skilled in the art will become aware of numerous modifications and amendments which fall within the scope of the present disclosure which is defined by the following claims.

What is claimed is:

1. A method for controlling a combustion engine including multiple combustion chambers, and multiple, individually-actuated injectors for injecting fuel into the combustion chambers, wherein at least one injector is assigned to each combustion chamber, and wherein the combustion engine further includes a common rail for supplying fuel to multiple injectors, the method comprising:

actuating the injectors in accordance with a requested fueling map, the actuation being associated with an unchanged actuation according to the requested fueling map;

monitoring an exhaust gas temperature of each combustion chamber;

determining an average exhaust gas temperature of the combustion chambers;

determining whether the exhaust gas temperature of the combustion chamber deviates by more than a predetermined value from the average exhaust gas temperature; and changing actuation of the injector assigned to the combustion chamber having exhaust gas temperature deviating by more than the predetermined value from the average exhaust gas temperature in order to change an amount of fuel injected, and limiting to a predetermined maximum the number of changes away from the unchanged actuation according to the requested fueling map for each injector.

2. The method according to claim 1, wherein the predetermined value is a predetermined percentage of the average exhaust gas temperature.

3. The method according to claim 1, wherein the predetermined value of the temperature deviation lies between 10° C. and 30° C.

4. The method according to claim 3, wherein the predetermined value of the temperature deviation is approximately 20° C.

5. The method according to claim 1, wherein the value of each change is a predetermined value.

6. The method according to claim 1, wherein changing actuation is associated with a change to an actuation waveform, and the overall value of the change to the actuation waveform of a respective injector is limited.

7. The method according to claim 5, wherein changing actuation is associated with a change to an actuation waveform, and the value of each change or the overall value of the change to the actuation waveform of each respective injector is specified as a percentage of the unchanged actuation waveform.

8. The method according to claim 7, wherein the total value of the change to the actuation waveform of the respective injector is limited to 10%.

9. The method according to claim 1, wherein the method is repeated cyclically.

10. The method according to claim 9, wherein changing actuation is associated with a change to an actuation waveform, and following a change to the actuation waveform of an injector, a predetermined period of time elapses before the method is repeated cyclically, the predetermined period of time being longer than a normal period of time between cyclical repetitions.

11. The method according to claim 1, wherein changing actuation is associated with a change to an actuation waveform, and including recording settings for changes in the actuation waveform of an injector.

12. The method according to claim 11, wherein the change settings are maintained when the combustion engine is restarted.

13. The method according to claim 11, wherein the change settings are reset when the combustion engine is restarted.

14. The method according to claim 1, further including determining whether the exhaust gas temperature of a combustion chamber deviates by more than a maximum predetermined value from the average exhaust gas temperature, the maximum predetermined value being greater than the acceptable predetermined value, and issuing a warning signal if there is a deviation which is greater than the maximum predetermined value.

15. The method according to claim 6, wherein the value of each change or the overall value of the change to the actuation waveform of each respective injector is specified as a percentage of the unchanged actuation.

16. The method according to claim 15, wherein the total value of the change to the actuation waveform of a respective injector is limited to 10%.

17. The method according to claim 15, wherein the total value of the change to the actuation waveform of a respective injector is limited to 5%.

18. The method according to claim 8, wherein the total value of the change to the actuation waveform of a respective injector is limited to 5%.

19. The method of claim 1, wherein changing actuation is associated with a change to an actuation waveform, and changing actuation includes, using a small percentage of the fueling from actuation of the injectors in accordance with the requested fueling map, for incremental changes of the injector actuation waveform.

20. The method of claim 1, including an associated cylinder for each combustion chamber, and including allowing for a predefined cylinder exhaust gas temperature offset due to cylinder location.

21. A system for controlling a combustion engine including a plurality of combustion chambers, and a plurality of individually actuable injectors configured to inject fuel into the combustion chambers, wherein at least one injector is assigned to each combustion chamber, the system comprising a control unit configured to perform a series of steps, the steps including:

actuate each injector to inject fuel into associated combustion chambers in accordance with a request profile;

monitor an exhaust gas temperature of each combustion chamber;

determine an average exhaust gas temperature of the combustion chambers;

determine whether the exhaust gas temperature of the combustion chamber deviates by more than a predetermined value from the average exhaust gas temperature;

change actuation of the injector of an associated combustion chamber having exhaust gas temperature deviating by more than the predetermined value from the average exhaust gas temperature, in order to change an amount of fuel injected; and wait a predetermined period of time following a change to the actuation waveform of an injector, then repeat the steps cyclically, the predetermined period of time being longer than a normal period of time between cyclical repetitions.

22. The system of claim 21, wherein the control unit is configured to change actuation of the injector assigned to the combustion chamber having exhaust gas temperature deviating by more than 30° C. from the average exhaust gas temperature.

23. The system of claim 21, wherein the control unit is configured to limit the number of changes away from the unchanged actuation according to the request profile for each injector to a predetermined number of changes.

24. The system of claim 21, wherein the control unit is configured to record settings for changes in actuation of the injector, and either to maintain change settings when the combustion engine is restarted, or to reset the change settings when the combustion engine is restarted.

25. The system of claim 21, wherein the control unit is further configured to determine whether the exhaust gas temperature of a combustion chamber deviates by more than a further predetermined value from the average exhaust gas temperature, the further predetermined value being greater than the predetermined value, and to issue a warning signal if there is a deviation which is greater than the further predetermined value.

26. A combustion engine including:

a plurality of combustion chambers;

at least one injector associated with each of the plurality of combustion chambers and configured to inject a quantity of fuel into an associated combustion chamber in accordance with a request profile; and a control unit configured to change the quantity of fuel injected by the at least one injector in response to a deviation of exhaust gas temperature from the associated combustion chamber by more than a predetermined value from an average exhaust gas temperature of all of the plurality of combustion chambers, and determining whether the exhaust gas temperature of a combustion chamber deviates by more than a maximum predetermined value from the average exhaust gas temperature, the maximum predetermined value being greater than the acceptable predetermined value, and issuing a warning signal if there is a deviation which is greater than the maximum predetermined value.

27. The engine of claim 26, further including:

an exhaust gas line associated with each of the plurality of combustion chambers; and a respective temperature sensor associated with each of the exhaust gas lines and configured to determine the exhaust gas temperature of the associated combustion chamber.

28. The engine of claim 27, further including:

a common exhaust gas line receiving exhaust gas from the exhaust gas lines associated with the plurality of combustion chambers; and a temperature sensor associated with the common exhaust line and configured to measure an average exhaust gas temperature of all of the combustion chambers.

29. The engine of claim 26, further including:

a common rail for supplying fuel to the at least one injector associated with each of the plurality of combustion chambers.

* * * * *